US007198186B2

(12) United States Patent
Kling et al.

(10) Patent No.: US 7,198,186 B2
(45) Date of Patent: Apr. 3, 2007

(54) SUPPORT FRAME FOR A RESPIRATORY AIR CONTAINER

(75) Inventors: Peter Kling, Berlin (DE); Andreas Haeuser, Berlin (DE)

(73) Assignee: MSA Auer GmbH, Berlin (DE)

( * ) Notice: Subject to any disclaimer, the term of this patent is extended or adjusted under 35 U.S.C. 154(b) by 244 days.

(21) Appl. No.: 10/311,792

(22) PCT Filed: Apr. 6, 2001

(86) PCT No.: PCT/DE01/01459

§ 371 (c)(1),
(2), (4) Date: Aug. 28, 2003

(87) PCT Pub. No.: WO01/97917

PCT Pub. Date: Dec. 27, 2001

(65) Prior Publication Data

US 2004/0045991 A1 Mar. 11, 2004

(30) Foreign Application Priority Data

Jun. 19, 2000 (DE) ..... 100 30 192

(51) Int. Cl.
*A45F 3/00* (2006.01)

(52) U.S. Cl. ..... 224/628; 224/632; 224/634

(58) Field of Classification Search ..... 224/628, 224/631, 632, 633, 634, 148.2, 148.5; 128/205.22
See application file for complete search history.

(56) References Cited

U.S. PATENT DOCUMENTS

| | | | | |
|---|---|---|---|---|
| 2,764,151 | A * | 9/1956 | Cupp | 128/202.22 |
| 2,854,001 | A * | 9/1958 | Humblet | 128/202.22 |
| 3,957,183 | A * | 5/1976 | Gadberry | 224/628 |
| 4,049,164 | A * | 9/1977 | Sullivan et al. | 224/633 |
| 4,310,110 | A * | 1/1982 | Dexter | 224/246 |
| 4,327,851 | A * | 5/1982 | Feathers | 224/634 |
| 4,640,215 | A * | 2/1987 | Purifoy, Jr. | 114/315 |
| 4,660,751 | A * | 4/1987 | von Dewitz | 224/632 |
| 4,860,936 | A * | 8/1989 | Lowe | 224/632 |
| 5,004,135 | A * | 4/1991 | Dufournet et al. | 224/632 |
| 5,249,890 | A * | 10/1993 | Bergstrom | 405/186 |
| 5,284,279 | A * | 2/1994 | Sason et al. | 224/632 |
| 5,346,419 | A * | 9/1994 | Kaiser | 441/96 |
| 5,378,084 | A * | 1/1995 | Walters et al. | 405/186 |
| 5,419,473 | A * | 5/1995 | Lamar | 224/632 |
| 5,449,102 | A * | 9/1995 | Sason | 224/632 |
| 5,503,314 | A * | 4/1996 | Fiscus | 224/665 |
| 5,562,513 | A * | 10/1996 | Kaiser | 441/111 |
| 5,586,705 | A * | 12/1996 | Leonard | 224/631 |
| 5,607,258 | A * | 3/1997 | Eungard | 405/186 |
| 5,620,282 | A * | 4/1997 | Stinton | 405/186 |
| 5,626,270 | A * | 5/1997 | Tseng | 224/148.7 |
| 5,887,771 | A * | 3/1999 | Perry | 224/190 |
| 5,954,250 | A * | 9/1999 | Hall et al. | 224/262 |
| 6,290,111 | B1 * | 9/2001 | Hedenberg et al. | 224/262 |

FOREIGN PATENT DOCUMENTS

| | | |
|---|---|---|
| DE | 29704328 | 7/1997 |
| GB | 2247653 | 3/1992 |
| WO | WO97/30609 | 8/1997 |

* cited by examiner

*Primary Examiner*—Nathan J. Newhouse
*Assistant Examiner*—Justin M. Larson
(74) *Attorney, Agent, or Firm*—Wood, Phillips, Katz, Clark & Mortimer

(57) ABSTRACT

A support frame for a respiratory air container that can be adjusted to the torso length of a user. The support frame has a support plate with shoulder straps and to which at least one respiratory air container is fastened and from which pneumatic and electric supply lines originate. An extension plate is provided on the support plate and can be moved in a longitudinal direction and locked into various positions with supply lines attached to it. Shoulder straps can be fastened to a support free end of the extension plate.

15 Claims, 2 Drawing Sheets

SUPPORT FRAME FOR A RESPIRATORY AIR CONTAINER

BACKGROUND OF THE INVENTION

1. Field of the Invention

The invention relates to a support frame for a respiratory air container that can be adjusted to the torso length of the user and having a support plate with shoulder straps and fastening structure for at least one respiratory air container from which pneumatic and electric supply lines originate.

2. Background Art

Apparatuses consisting of a support plate and shoulder straps are known to be used for stable fixing of respiratory air containers (compressed-air breathing apparatuses) on the back of their respective user, e.g. a fire fighter.

The support plates are usually made in one piece and at a uniform size while their shape is adjusted to the contour of the human back. The respiratory air container that is held on the support plate using a bottle strap is connected to a pressure reducer located at the lower end of the support plate from which several supply lines originate and run, inter alia, to a pressure gauge and respiratory inlet of a mask the user is wearing. The hose pipes for compressed air and, optionally, electric supply lines for warning and measuring equipment are attached to the support plate. The support plate rests at various heights against its wearer's body depending on the wearer's height: with a short person, it ends in the upper part and with a taller person it ends in a lower part of that person's back. Correspondingly, the length of hose or line available at the user's front side is either too great or too small, and hose pipes that are either too long or too short impede the user's free and unobstructed movement. In addition, there is a risk that hose or line portions that do not run close to the user's body or that are freely accessible at the user's back and outside the user's field of vision may get caught on obstacles or be damaged.

U.S. Pat. No. 5,020,941 describes a support frame for respiratory air containers to be mounted to a user's body that has replaceable shoulder parts of different lengths to adjust the support frame to the height of its respective wearer. In addition to the fact that the pneumatic and, optionally, electric supply lines are exposed in this proposed solution, its adjustment to user height also takes a great effort.

EP 0 747 095 A2 describes a support frame that is also suited for mounting respiratory air containers and has a two-part design. It consists of an upper back plate and a lower support plate, and the lower support plate can be hinged to the upper back plate at different heights. This support frame, however, also leaves supply lines unprotected, and the type of length variability in conjunction with the hinged support plate does not contribute to keeping the respiratory air container stably mounted on the support plate.

SUMMARY OF THE INVENTION

It is therefore the object of this invention to provide a support frame for a respiratory air container that can be adapted to the height of the respective user, keeps the respiratory air container steadily fixed, and conducts pneumatic or electric supply lines so that they are protected or kept close to the body in an ergonomically favorable arrangement.

An extension plate is mounted to the support plate that can be moved and locks into various positions. The shoulder straps of the support frame and supply lines of the respiratory air container are attached to this extension plate. A support frame that has this design can be adjusted regarding its length and the conduction of the supply lines to the torso length of the respective user so that the frame is firmly attached to the body and supply lines are conducted close to the body. The supply lines that form a reserve loop resting against the support plate when the extension plate is in its lowest position are, as it were, expanded when the extension plate is drawn out and shortened when the extension plate is pushed back in so that they always have the optimum length and position for the respective user and are neither too long nor too short, thus ensuring safe handling of any devices connected to them. A support frame configured in this way allows its user to move freely and safely, regardless of the user's height and despite carrying a heavy respiratory container and the associated supply lines.

According to another characteristic of the invention, a duct for receiving and protecting the supply lines is provided in the extension plate and runs in longitudinal direction. An advantageous improvement of the invention is to guide the extension plate via its receiving duct in a guiding channel of the support plate that is open towards the user's back. The supply lines are fed into the receiving duct of the extension plate through a supply line inlet hole from the accessible side of the support plate. This characteristic provides special protection for the supply lines that emerge from the support frame in the shoulder section of the user only, regardless of the user's height.

BRIEF DESCRIPTION OF THE DRAWINGS

An embodiment of the invention that illustrates other characteristics, useful embodiments, and advantages shall be explained in greater detail with reference to the figures, wherein.

DETAILED DESCRIPTION OF THE DRAWINGS

Figure 1:
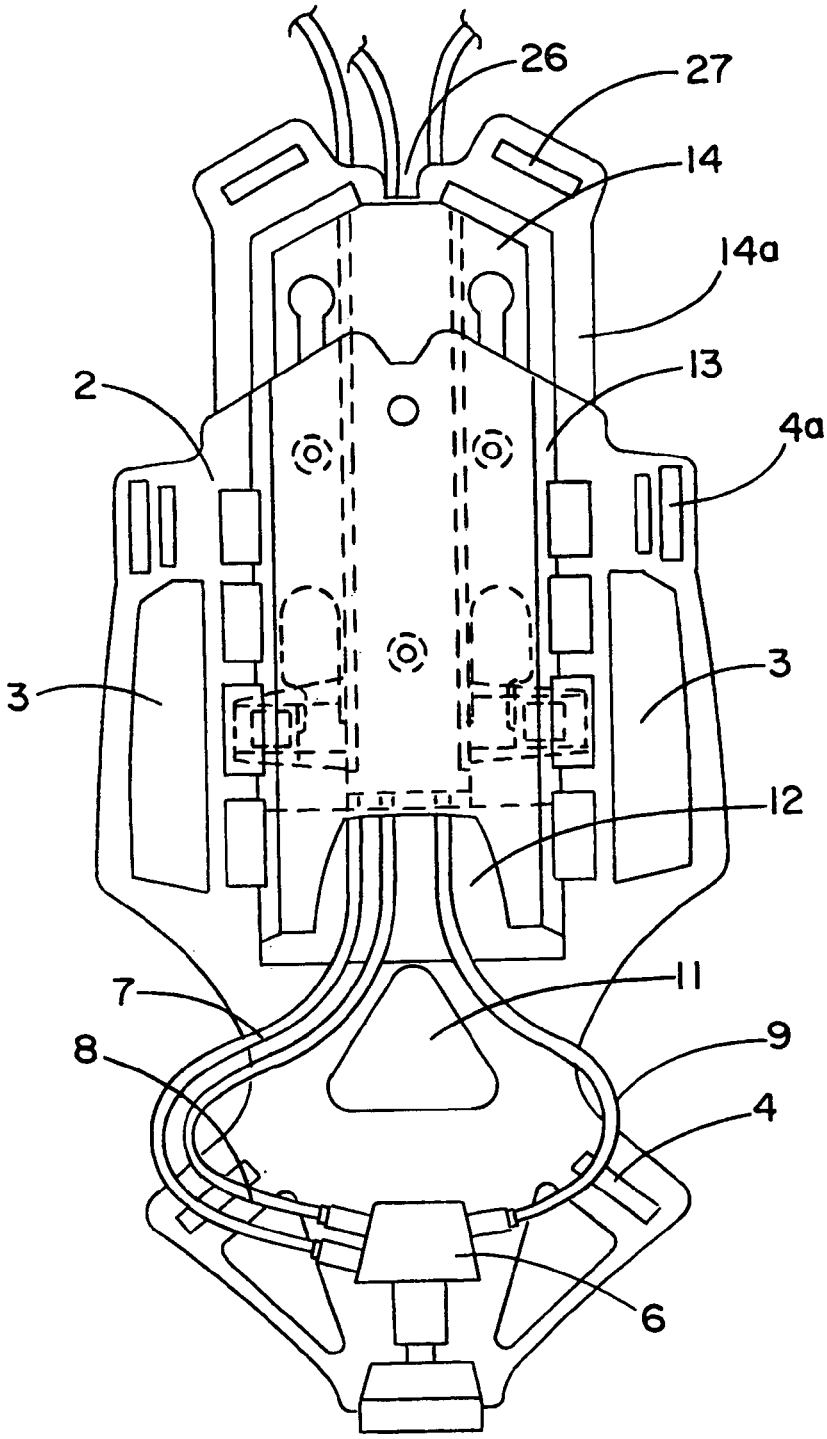
FIG. 1 shows a view of the side facing away from the wearer of the support frame that can be adjusted in length according to the invention with the pressure reducer and supply lines connected to it, but without shoulder straps and respiratory air container.
Figure 2:
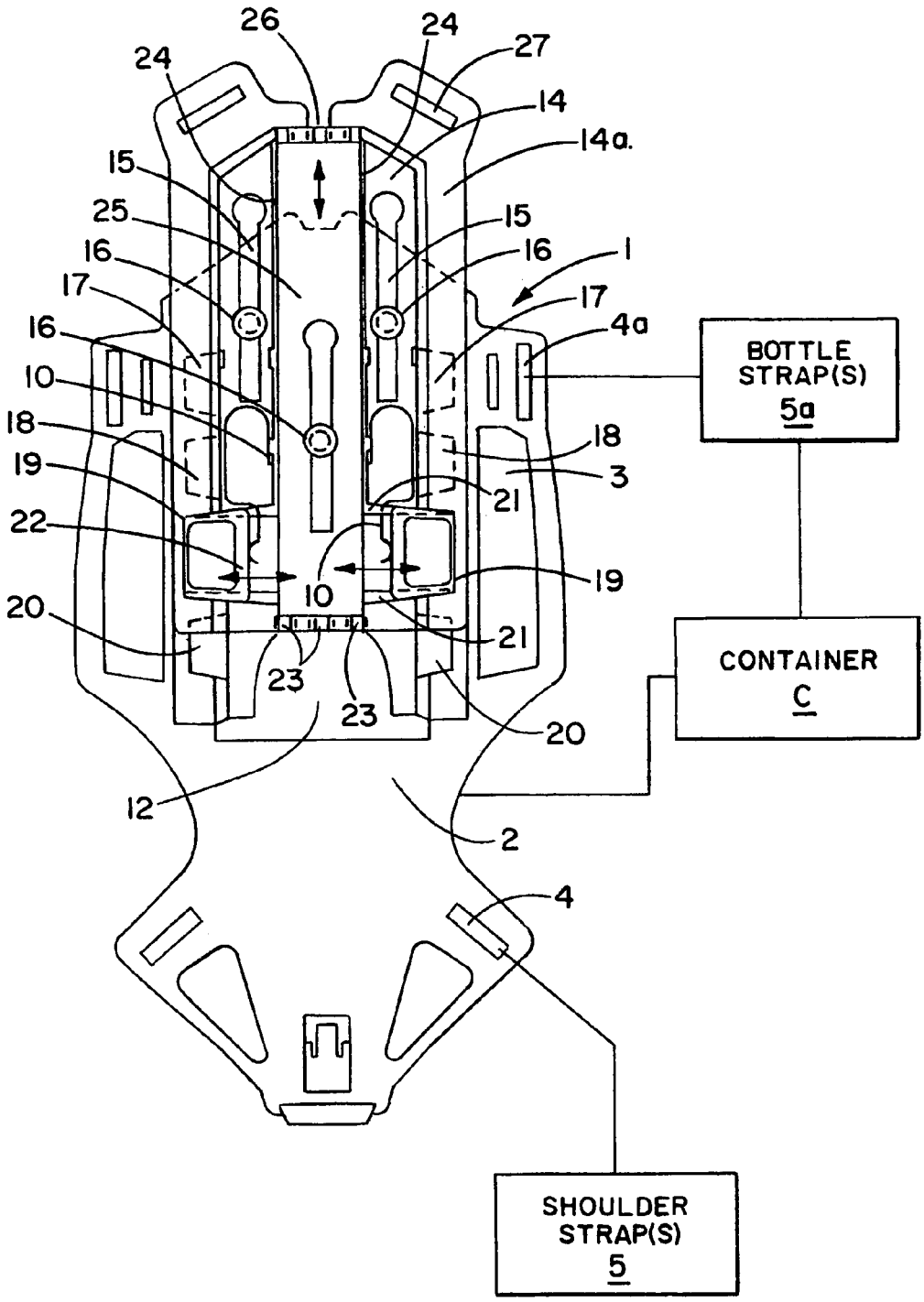
FIG. 2 shows a rear view, i.e. the side facing the user's back, of the support frame shown in FIG. 1.

The support frame 1 consists of a deflection-resistant support plate 2 made of an impact-resistant synthetic material with lateral handles 3 and first slotted holes 4 for the shoulder straps 5 and second slotted holes 4*a* for a bottle strap 5*a* for fastening a compressed-air container C to the support plate 2. A pressure reducer 6 is mounted to the lower end of the support plate 2 which also holds the compressed-air container C connected to it and from which, forming a reserve loop, a first supply line (pressure gauge hose) 7 to a pressure gauge (not shown), a second supply line 8 as the air supply line for the user, and a third supply line 9 as an alarm signal line originate. The support plate 2 has a shallow U-shaped guiding channel 13 along its longitudinal axis on the side facing away from the user that ends in the lower section of the support plate 2 in a supply line inlet hole 12 above the protruding hose fitting 11 that is molded to the support plate 2. The hose pipes/supply lines 7, 8 and 9 enter the flat guiding channel 13 formed on the rear side (the side facing away from the user's back) of the support plate 2 through the line inlet hole 12. The guiding channel 13 houses a fitted-in, generally U-shaped extension plate 14 that is movably held and guided via the guide slots 15 and guiding pins 16. The extension plate 14 with slotted holes 27 for fastening the shoulder straps 5 can be locked into four positions in the guiding channel 13 of the support plate 2. Pairs of opposing locking grooves 17, 18, 19 and 20 are molded to the opposing side walls of the guiding channel 13 for this purpose, into which locking grip ends 22 on the extension plate 14 lock that are elastically held in a guiding groove 21 by means of a spring element 10. The extension plate 14 that can be locked into various locking positions (locking grooves 17 to 20) allows to provide support frames 1 in various lengths that fit the height (or torso length) of their users. In the embodiment shown, the locking grip ends 22 are located in the locking recesses 19 so that the support frame 1 shown can be extended or shortened.

The locking grip ends 22 are designed as large cups that are open at the top so that they can be handled easily even when the user is wearing protective gloves. The extension plate 14 has an outward facing shoulder 14*a* on its two longitudinal edges. These shoulders 14*a* cover the locking grooves 17 to 20 in the sidewalls of the guiding channel 13 of the support plate 2 at the top and simultaneously provide a bearing surface on the user's back. Inward facing clamping grooves 23 are provided on the lower edge of the extension plate 14 to which the supply line 7 to 9 shown in FIG. 1 can be clamped and thus tightened. The supply lines 7 to 9 are conducted in a receiving duct 25 formed on the inside (the side facing the user's back) of the extension plate 14 by two longitudinal webs 24 and emerge from a line outlet hole 26 in the extension plate 14 between third slotted holes 27.

As FIG. 1 shows, the supply lines 7 to 9 that are connected to a pressure reducer are arranged in the form of a reserve loop resting against the support plate 2 so that they end in the chest section of a short user at a height that ensures free handling of, and easy access to, units connected to them as well as unhindered movement of the user. When a user's torso is longer or shorter, the extension plate 14 is adjusted in such a way that the third slotted holes 27 are placed in a position close to the shoulders that ensures a firm seat of the support frame 1 and simultaneously adjusts the position of the supply lines 7 to 9 fastened to the extension plate 14 and following its movements to the user's torso length. The supply lines 7 to 9 that emerge as a bundle from the line outlet hole are conducted close to the user's body in the user's shoulder and chest area so that the risk that they get caught on something and be damaged is low. This also applies to the unchecked back area of the user where the supply lines 7 to 9 are protected and secured in the receiving duct 25 between the user's back and the support frame 1 and kept close to the support plate 2 in the area where they are exposed (reserve loop). Thus a support frame is provided that ensures a stable position of the compressed-air container and protected conducting of the supply lines close to the user's body and ending at an anatomically optimal height in front of the user's body. The user's range of movement and safety are improved.

The invention is not limited to the embodiment of a support frame described above. Numerous modifications can be made within the concept of the invention, which consists in the extension plate 14 that can be locked into different positions along the expandable support plate 2 and has a receiving duct 25 for protected conducting of the supply lines on the user's back and in moving these supply lines with the movement of the extension plate 14. If the supply lines 7, 8, 9 are very stiff, it is also conceivable to just conduct them in the receiving duct 25 and not move them along with the extension plate 14. In addition, the proposed support frame 1 is not restricted to the use for respiratory air containers but can also be used for fastening and carrying other objects.

LIST OF REFERENCE SYMBOLS

1 Support frame
2 Support plate
3 Handles
4 First slotted holes
5 Second slotted holes
6 Pressure reducer
7 First supply line
8 Second supply line
9 Third supply line
10 Spring element
11 Protruding hose fitting
12 Line inlet hole
13 Guiding channel (for extension plate)
14 Extension plate
14*a* Longitudinal shoulders of 14
15 Guide slots
16 Guiding pins
17 Locking grooves for 22
18 Locking grooves for 22
19 Locking grooves for 22
20 Locking grooves for 22
21 Guiding groove for 22
22 Locking grip ends
23 Clamping grooves
24 Longitudinal webs
25 Receiving duct
26 Line outlet hole
27 Third slotted holes

We claim:

1. A support frame for a respiratory air container that can be adjusted to the torso length of a user, the support frame comprising:

a support plate attachable to a user's back and to which at least one respiratory air container can be attached, from which pneumatic and electric supply lines originate; and an extension plate on the support plate, the extension plate having attached supply lines and movable guidingly in a longitudinal direction relative to the support plate into various positions and capable of being locked into the various positions, and the extension plate has a support free end to which shoulder straps can be fastened, wherein a receiving duct extending in the longitudinal direction is provided in the extension plate for protected conducting of the supply lines.

2. The support frame according to claim 1, wherein the extension plate is generally U-shaped, the generally U-shaped extension plate is guided in a generally U-shaped guiding channel of the support plate that is open towards the back of a user wearing the support frame, said guiding channel comprising a line inlet hole for conducting the supply lines into the receiving duct.

3. The support frame according to claim 1, wherein clamping grooves for the supply lines are provided in the receiving duct to move the supply lines along with the extension plate, and the supply lines form a reserve loop that rests against the support plate when the extension plate is in a lower position and the support frame thus is shorter.

4. The support frame according to claim 1, wherein locking grip ends with a spring element are provided in opposing guiding grooves and can be used to lock the extension plate into a desired position by engaging into locking grooves provided in a guiding channel.

5. The support frame according to claim 1, wherein the extension plate is held and guided in a plurality of guiding channels of the support plate using at least one guiding pin in each guiding channel.

6. The support frame according to claim 1, wherein a protruding hose fitting is molded to the support plate between a line inlet hole and a receiving duct.

7. The support frame according to claim 1, further in combination with a respiratory air container from which the pneumatic and electrical supply lines originate.

8. A support frame for a respiratory air container, the support frame comprising:

a support plate with fastening means for at least one respiratory air container, from which pneumatic and electric supply lines originate; and an extension plate connected at an upper end with shoulder straps, wherein the support plate has a generally U-shaped guiding channel that is open towards the back of the user and in which the extension plate is guided in a longitudinal direction, wherein the guiding channel and the extension plate have guiding means and locking means to lock the extension plate into various positions, wherein the supply lines are attached to the extension plate.

9. The support frame according to claim 8, wherein the locking means comprises:

spring biased locking grip ends provided in opposing guiding grooves of the extension plate; and a plurality of locking grooves provided in the guiding channel and engaged in a desired position by the locking grip ends.

10. The support frame according to claim 8 wherein the guiding means are guiding pins held and guided in guide slots.

11. The support frame according to claim 8, further in combination with a respiratory air container from which the pneumatic and electrical supply lines originate.

12. The support frame according to claim 8, wherein a receiving duct extending in a longitudinal axis is provided in the extension plate for conducting the supply lines.

13. The support frame according to claim 12, wherein the receiving duct comprises clamping grooves to attach the supply lines and to move the supply lines along with the extension plate, and wherein the supply lines form a reserve loop in a lower position of a shortened support frame.

14. The support frame according to claim 12, wherein the guiding channel comprises a line inlet hole for conducting the supply lines into the receiving duct.

15. The support frame according to claim 14, wherein a protruding hose fitting is molded to the support plate between the line inlet hole and the receiving duct.

* * * * *